US009593449B2

(12) United States Patent
Mickelat et al.

(10) Patent No.: US 9,593,449 B2
(45) Date of Patent: Mar. 14, 2017

(54) SCREENING DEVICE

(71) Applicant: ANDRITZ FIEDLER GMBH, Regensburg (DE)

(72) Inventors: Thomas Mickelat, Nittenau (DE); Michael Reinstein, Teublitz (DE)

(73) Assignee: ANDRITZ FIEDLER GMBH, Regensburg (DE)

( * ) Notice: Subject to any disclaimer, the term of this patent is extended or adjusted under 35 U.S.C. 154(b) by 0 days.

(21) Appl. No.: 14/902,461

(22) PCT Filed: Jun. 16, 2014

(86) PCT No.: PCT/EP2014/001631
§ 371 (c)(1),
(2) Date: Dec. 31, 2015

(87) PCT Pub. No.: WO2015/000551
PCT Pub. Date: Jan. 8, 2015

(65) Prior Publication Data

US 2016/0153139 A1 Jun. 2, 2016

(30) Foreign Application Priority Data

Jul. 1, 2013 (DE) ..... 10 2013 010 959

(51) Int. Cl.
*D21D 5/16* (2006.01)
*B07B 1/18* (2006.01)

(52) U.S. Cl.
CPC *D21D 5/16* (2013.01); *B07B 1/18* (2013.01)

(58) Field of Classification Search
CPC ..... D21D 5/16; B07B 1/18
(Continued)

(56) References Cited

U.S. PATENT DOCUMENTS 5,200,072 A 4/1993 Frejborg et al.
6,491,168 B1 * 12/2002 Lutz ..... B01D 29/111 209/273

(Continued)

FOREIGN PATENT DOCUMENTS

DE EP 0 471 195 A1 2/1992
DE EP 1 114 218 B1 5/2003

OTHER PUBLICATIONS

International Search Report issued by the European Patent Office in International Application PCT/EP2014/001631.

*Primary Examiner* — Mark Halpern
(74) *Attorney, Agent, or Firm* — Henry M. Feiereisen LLC

(57) ABSTRACT

A screening device for fibrous stock suspensions of the paper industry includes at least two separate screening baskets which are connected axially behind one another in the interior of a reinforcing device in the form of a back-up cylinder. A variable-diameter intermediate ring is arranged between the screening baskets. The reinforcing device has a cover part and a bottom part. By way of axial tensile force loading of the arrangement, the intermediate ring is loaded so as to bear radially in the circumferential direction in a gap-free manner against the associated axial ends or screening basket flanges of the screening baskets. The screening baskets are then clamped and fixed in a centrally positioned manner by the intermediate ring in cooperation with the end-side flange of the reinforcing device, the cover part, the bottom part and the intermediate ring.

12 Claims, 8 Drawing Sheets

(58) Field of Classification Search
USPC ..... 162/232
See application file for complete search history.

(56) References Cited

U.S. PATENT DOCUMENTS

| | | | | |
|---|---|---|---|---|
| 6,579,458 | B2 | 6/2003 | Mickelat et al. | |
| 7,491,296 | B2 * | 2/2009 | Fredriksson | D21D 5/026 162/246 |
| 7,931,779 | B2 * | 4/2011 | Fredriksson | D21D 5/026 162/246 |
| 8,292,086 | B2 | 10/2012 | Mickelat et al. | |
| 8,303,769 | B2 * | 11/2012 | Engelfeldt | D21D 5/026 162/242 |
| 2002/0148763 | A1 | 10/2002 | Lutz et al. | |

* cited by examiner

SCREENING DEVICE

CROSS-REFERENCES TO RELATED APPLICATIONS

This application is the U.S. National Stage of International Application No. PCT/EP2014/001631, filed Jun. 16, 2014, which designated the United States and has been published as International Publication No. WO 2015/000551 A1 and which claims the priority of German Patent Application, Serial No. 10 2013 010 959.0, filed Jul. 1, 2013, pursuant to 35 U.S.C. 119(a)-(d).

BACKGROUND OF THE INVENTION

The invention relates to a screening device, which is intended for fibrous suspensions in the paper industry and is used for example with sorters, pressure screens and the like.

A screening device of the generic type, which has a substantially cylindrical screening device forming a screen surface, is known from EP 1 114 218 B1. The screening device is supported by a radially spaced-apart reinforcing device, which is designed in particular in the form of a support sleeve, also referred to as "backup cylinder". The screening device is replaceable as a unit which allows easy replacement of the highly stressed screening device which is prone to wear and reuse of the reinforcing device, such as the support sleeve.

Screening plates and screening cylinders and methods for their production are known from EP 0 471 195 A1 and the corresponding U.S. Pat. No. 5,200,072. A cylindrical screening device is designed such that the screening device or the corresponding screening element is removably and replaceably connected to a support cylinder serving as a reinforcing device. To reduce the manufacturing cost and manufacturing time, a worn screening device thus only needs to be replaced, while the reinforcing device, in particular of the supporting cylinders can be reused. For the releasable connection between the screening device and the sleeve-like reinforcement device, the outer diameter of the screening device is sized slightly larger than the inner diameter of the support cylinder. The screening device and the reinforcing device are then frictionally connected to each other by a temperature-dependent shrink process, wherein this connection can optionally be secured, for example, by welding, with rivets, screws, adhesives, or solder.

Although a sometimes time-consuming and labor-consuming exchange of the screening device is contemplated in all these known screening devices, the screening device itself is a unitary structure which is as such releasably secured by suitable means inside the reinforcing device in the form of the support sleeve.

SUMMARY OF THE INVENTION

The invention aims to provide a screening device of the generic type, which can be flexibly adapted to different screening tasks and screening requirements and used to increase efficiency. In particular, the screening device should be produced inexpensively. Furthermore, an assembly-friendly design should be created, thus potentially preventing possible assembly errors, while using particular the smallest possible number of parts in the assembly.

According to the invention, a screening device for fiber suspensions in the paper industry is provided for this purpose, with a substantially cylindrical screening basket forming a screen surface and a reinforcing device in the form of a support sleeve having a radial spacing from the screening basket and surrounding the screening basket, wherein the reinforcing device has at one axial end an end flange, which is characterized in that the screening device has at least two separate screening baskets, which are axially connected in series and arranged inside the reinforcing device in the form of a support sleeve with the interposition of an intermediate ring having a variable diameter such that the substantially cylindrical screening baskets are clamped and fixed at a central position in cooperation with the end-side end flange of the reinforcing device, a cover part, a bottom part and the intermediate ring.

The screening device according to the invention thus has a smaller number of individual parts to be assembled, namely a supporting shell, at least two screening baskets, an intermediate ring and a cover part. The screening device according to the invention is arranged such that due to the variable-diameter intermediate ring, the two screening baskets that are successively arranged in the axial direction are automatically centered and aligned with respect to one another in the interior of the reinforcing device in the form of the support sleeve in a predetermined manner. The assembly complexity and assembly time for assembling a screening device according to the invention can thus be particularly optimized, and at the same time the reinforcing device in the form of the support sleeve can be reused. In the screening device according to the invention, the variable-diameter intermediate ring performs, on the one hand, the function of centrally positioning the two screening baskets with respect to the reinforcing device and, at the same time, a clamping and fixing function in cooperation with the associated parts of the reinforcing device and the end(s) of the screening baskets. Due to the small number of matching components to be set inserted into one another, assembly errors can be largely avoided. The two successively arranged screening baskets allow each an optionally separate and flexible adaptation to the desired screening tasks and screening requirements. Thus, the structurally simple screening device can be universally adapted to the respective applications.

In a preferred embodiment, the variable-diameter intermediate ring is split, preferably slotted. Alternatively, the variable-diameter intermediate ring may be formed by an elastomer ring. In both cases, the intermediate ring is designed such that the diameter may expand or be spread apart under the action of an axial clamping force that clamps the parts of the screening device against each other such that the screening baskets are centered relative to one another as well as relative to the support device, and at the same time also fixed in this position.

In particular, the cover part and the bottom part of the screening device according to the invention form in cooperation with the front ends (screening basket flange) of the screening baskets a respective rotation-locked unit. In particular, a rotation lock is required at the respective ends of the screening baskets or screening basket flanges to effectively prevent relative movement of the two screening baskets during use. Preferably, the intermediate ring and the front ends of the screening baskets form a rotation-locked unit, thus allowing a secure and reliable and fixed association of the intermediate ring and the screening baskets in the screening device according to the present invention. A rotation-locked attachment can also .be achieved by frictional engagement in conjunction with the axial support of screening basket front end and support sleeve.

Advantageously, the rotation lock is formed by an interlocking pin and slot arrangement. This represents a technically and structurally simple design of an effective embodiment of a rotation lock.

According to a preferred embodiment of the screening device, the screening device is designed such that the cover part, the bottom part and the intermediate ring form a frictional connection with the screening baskets by way of a spline connection. The spline connection can advantageously be designed as a conical seat connection. This frictional connection produces after assembly of the components of the screening device according to the invention a final definitive association of components with one another, wherein the frictional connection can be disengaged by a simple separation, resulting in a simple removal or dismantling of the component.

To enable a universal adaptation to the respective screening tasks and screening requirements, the screening baskets may have different slot widths and/or slot shapes, in particular, they may have different pitches, profile depths, profile sizes or profile inclinations.

In particular, the screening device according to the invention is designed in such a way that for its assembly, a first screening basket is disposed in the reinforcing device so as to rest on the bottom part, the variable-diameter intermediate ring is placed on the upper axial end of the first screening basket, the second screening basket is arranged above it, and the cover part then is disposed on the upper axial end of the second screening basket, wherein when an axial clamping force is applied to the above arrangement, the intermediate ring is expanded or spread in diameter and abuts without any gap the associated axial ends of the screening baskets in the radial direction. This ensures that all eventual passage gaps on the overall arrangement of the components are effectively closed during assembly. Furthermore, due to this gap-free arrangement, the pressure forces are transferred at the axial ends (end flanges) of screening baskets to the reinforcement shell (backup cylinder) which increases and improves the stability of the screening device as a whole.

In summary, the invention discloses a screening device which includes at least two separate screening baskets arranged axially one behind the other in the interior of a backup cylinder which serves as a reinforcing device. When this screening device is being assembled, the separate screening baskets are centrally clamped and fixed to the reinforcing device in the form of backup cylinder by way of a variable-diameter intermediate ring arranged between the axial ends of the screening baskets or the screening basket flanges and by applying an axial clamping force to the assembly composed of the reinforcement device in the form of the back-up cylinder, the two screening baskets and the interposed intermediate ring.

The screening device according to the invention can therefore be easily and quickly assembled from components having a simple structure and design. In particular, only a small number of components need to be assembled the screening device according to the invention.

BRIEF DESCRIPTION OF THE DRAWING

The invention will now be explained in more detail below with reference to preferred embodiments illustrated in the appended drawing, which shows in.

DETAILED DESCRIPTION OF PREFERRED EMBODIMENTS

Figure 1:
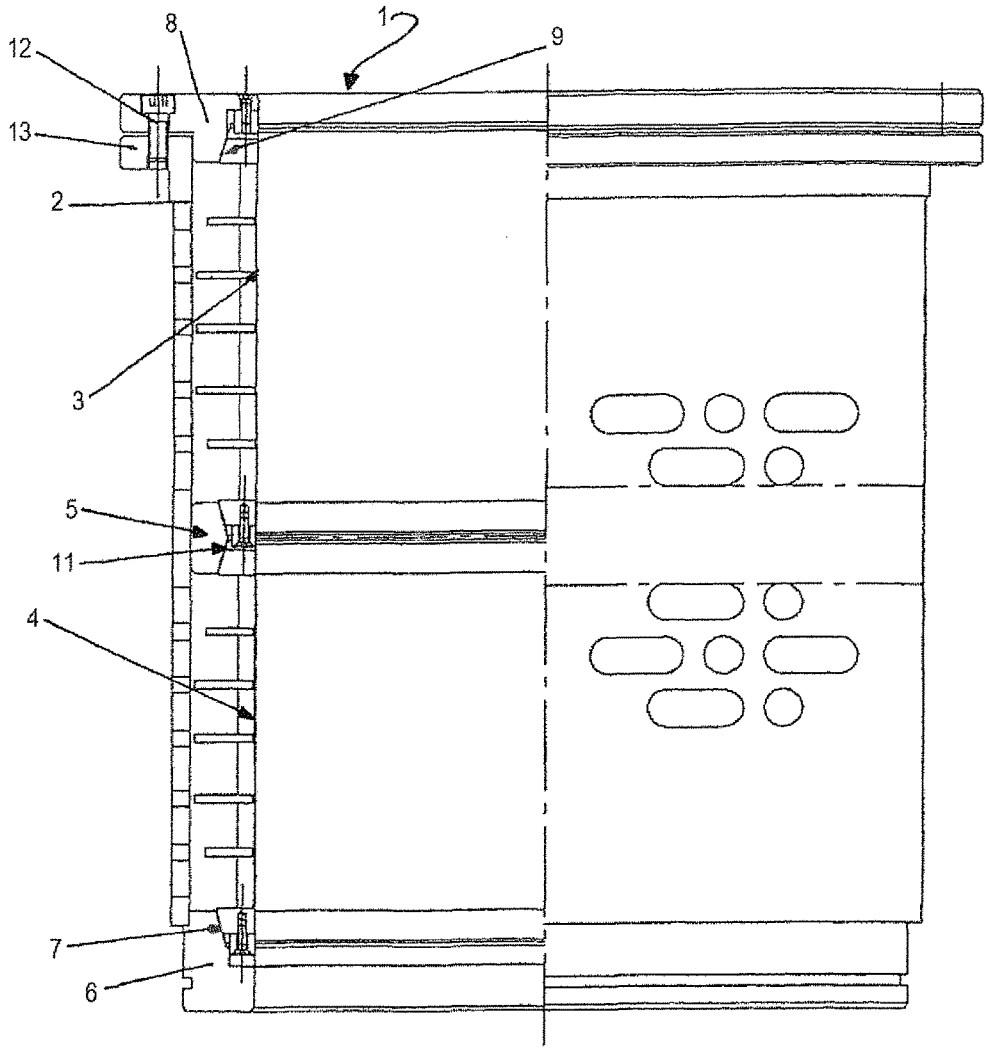
FIG. 1 a schematic structural drawing of the screening device according to the invention, in half section and transverse view.

Identical or similar parts in the figures of the drawing are given the same reference numerals. Furthermore, the representations do not represent limiting embodiments.

Referring now to FIG. 1, the essential components of a screening device according to the invention designated with the reference numeral 1 will now be briefly explained. The screening device 1 includes a reinforcing device 2 in the form of a support sleeve or "backup cylinder". In the illustrated embodiment, two separate screening baskets 3, 4 are arranged axially one behind the other in the interior of this reinforcing device 2. A variable-diameter intermediate ring 5, which cooperates with the respective front ends of the two abutting screening baskets 3, 4 in a manner to be described later, is arranged between the two screening baskets 3, 4. A bottom part 6, into which an end-side axial end of the screening basket 4 is inserted by way of a spline connection, preferably a conical seat connection 7, is provided in the lower region of the screening device 1. At the upper end in FIG. 1, the reinforcing device 2 is closed off by a cover part 8 which, on the one hand, cooperates via a non-positive connection in the form of a spline connection groove formed as a conical seat connection 9 with an upper end of the screening basket 3. On the other hand, the cover part 8 is secured to the reinforcing device 2 via clamping screws 12. An intermediate ring 5 is arranged between the reinforcing device 2 and the two axially facing ends of the two screening baskets 3, 4. To assemble such a screening device having the overall designation 1, a first screening basket 4 is inserted into the interior space formed by the reinforcing device 2 in the form of a supporting cylinder, such that the lower axial end of the screening basket 4 rests on the bottom part 6 via the non-positive connection in the form of a conical seat connection 7, for example, with an interference fit. The variable-diameter intermediate ring 5 is then placed on the upper axial end of the first screening basket 4. The second screening basket 3 is then arranged above the intermediate ring 5 in axial alignment with the first screening basket 4 and cooperates with the intermediate ring 5 via a non-positive connection, preferably a spline connection 11. Lastly, the cover part 8 is then attached on the upper axial end of the second screening basket 3 by way of the non-positive conical seat connection 9. With the aid of clamping screws 12, an axial clamping force is then applied to the overall arrangement composed of the cover part 8, the two screening baskets 3, 4, the interposed intermediate ring 5 and the bottom part 6.

Figure 2B:
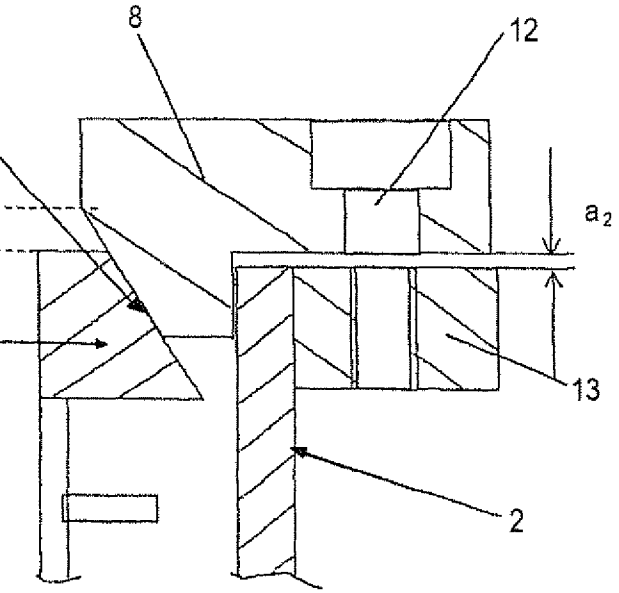
FIGS. 2*a* and 2*b* schematic views for illustrating the application of the axial clamping force.
Figure 2A:
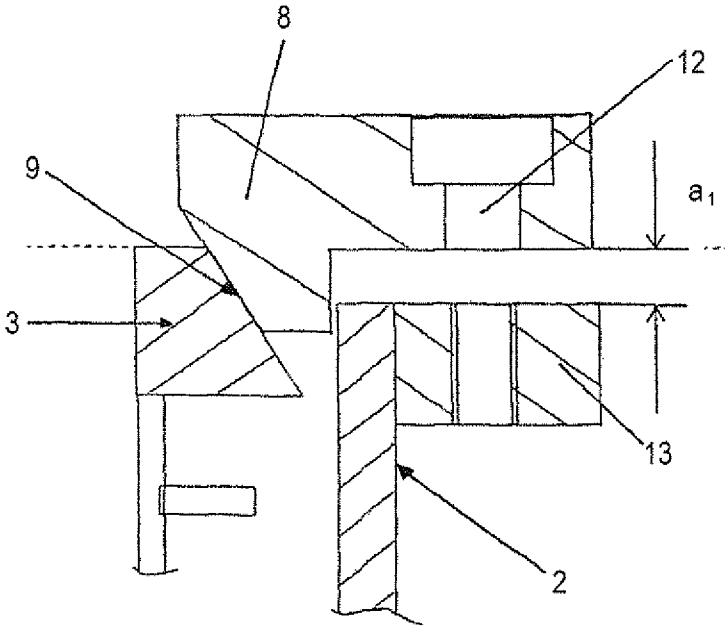

The application of the clamping force between the cover part 8, the reinforcing device 2 in the form of a support sleeve and the second screening basket 3 is illustrated schematically with reference to FIGS. 2*a* and 2*b*. FIG. 2*a* schematically illustrates the conditions, when the cover part 8 rests loosely on the conical seat connection 9. As indicated in FIG. 2*a*, for example, a distance $a_1$ exists in this state. As illustrated in FIG. 2*b*, this distance is substantially smaller after the clamping screws 12 are tightened and is designated therein by $a_2$.

Figure 3B:
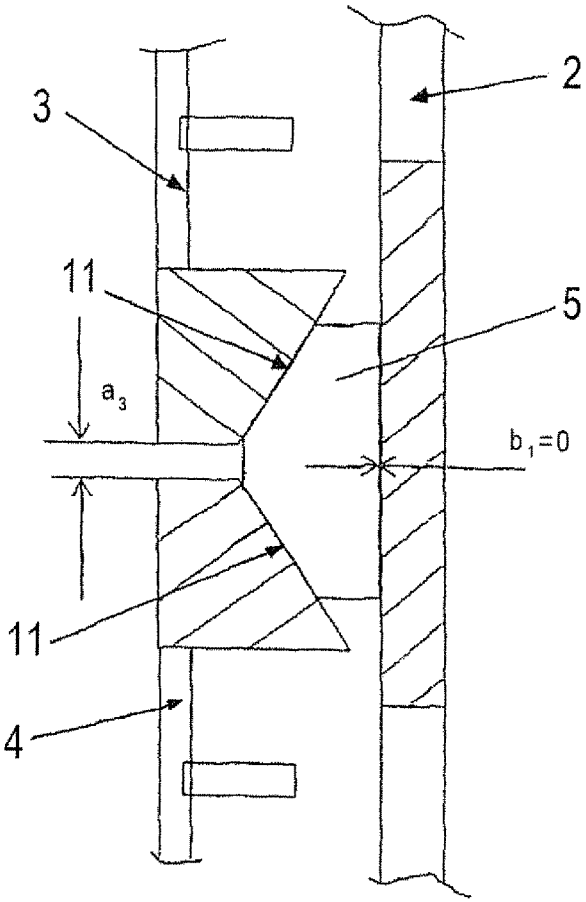
FIGS. 3*a* and 3*b* schematic views for illustrating the function of the intermediate ring before and after application of the clamping force in the screening device according to the invention.
Figure 3A:
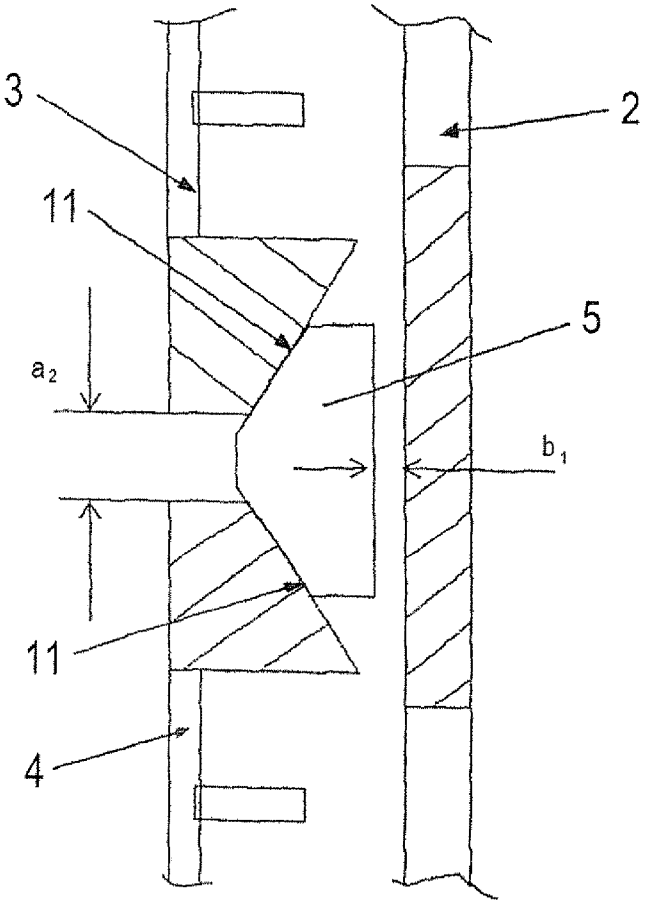

The operation of the intermediate ring 10 is illustrated schematically with reference to FIGS. 3*a* and 3*b*. FIG. 3*a* in association with FIG. 2*a* shows a schematic diagram where the intermediate ring 5 has, for example a distance $b_1$, from the interior wall of the reinforcing device 2. The two axial ends of the screening baskets 3, 4 have according to FIG. 3*a* for example a distance $a_2$. FIG. 3*b* shows the state when an axial clamping force is applied in accordance with FIG. 2*a*. When this axial clamping force is applied, the axial distance between the two baskets 3, 4 becomes smaller and decreases to $a_3$. The intermediate ring 10 is pressed directly against the interior wall of the reinforcing device 2 in the form of a support sleeve, and the distance previously designated in FIG. 3*a* with $b_1$ is canceled. In this case, the compressive forces can then be transferred to the reinforcing device 2 via the axial ends (end flanges) of the screening baskets 3, 4, thereby increasing and enhancing the overall stability to the screening device 1.

Figure 4B:
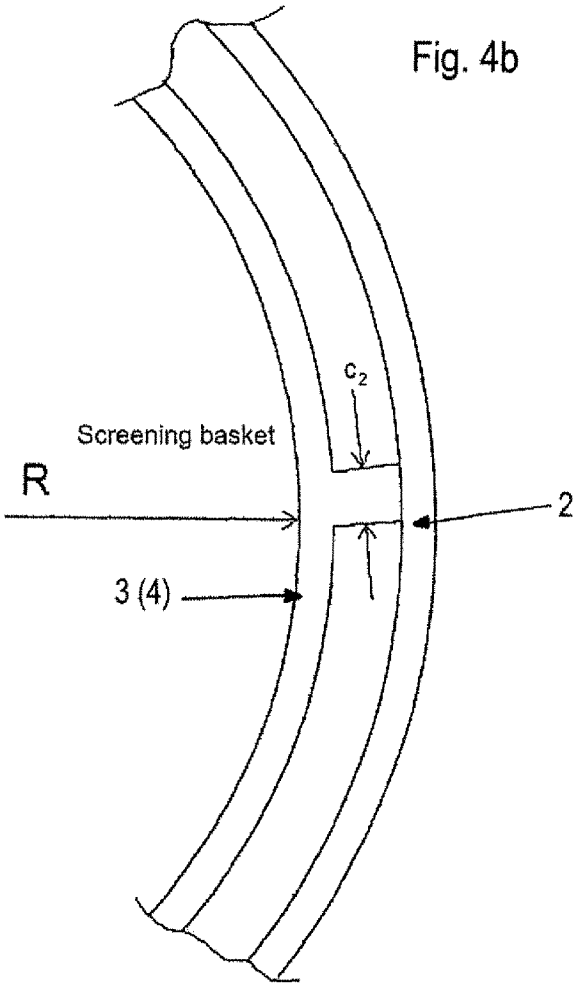
FIGS. 4*a* and 4*b* schematic views in association with FIGS. 3*a* and 3*b;*
Figure 4A:
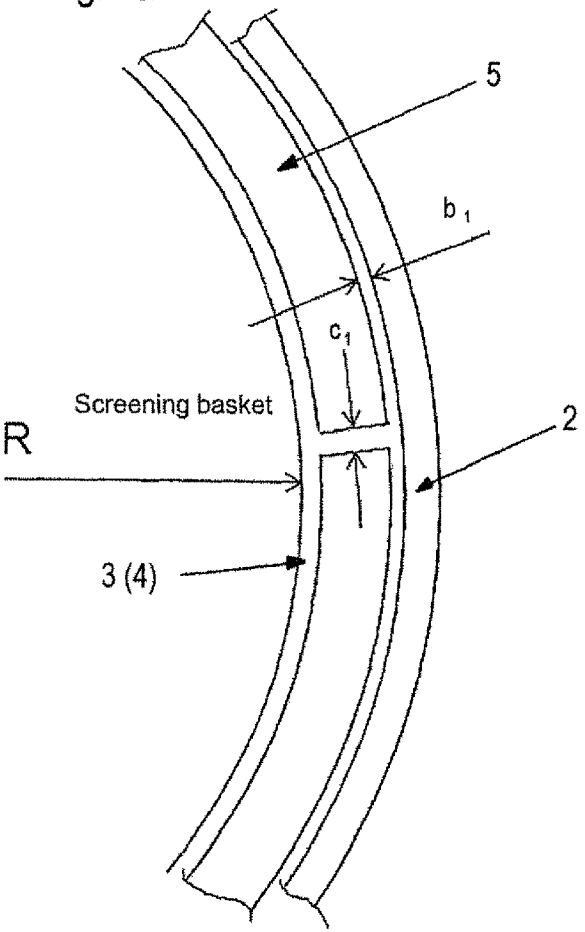

FIGS. 4*a* and 4*b* schematically illustrate the situation in a plan view. The intermediate ring 5 is in the illustrated, preferred embodiment designed with a variable diameter in that it is divided or slotted, meaning that this variable-diameter intermediate ring 5 is not closed at its circumferential ends, but has a spacing $c_1$ in the circumferential direction.

As seen from FIG. 4*b* in association with FIG. 3*b*, the intermediate ring 5 is spread apart in the circumferential direction by the axial clamping force application in such a way, the spacing between the circumferential ends of the split intermediate ring 5 is increased to $c_2$ with respect to FIG. 4*a*. At the same time, the spacing $b_1$ between the interior wall of the reinforcing device 2 is cancelled due to the effect of the clamping force.

As can inferred from FIGS. 2*a* to 4*b*, the variable-diameter intermediate ring 5 is arranged between the axially opposite two ends of the two screening baskets 3, 4 in the interior of the reinforcing device 2 in the form of a support sleeve in such a manner that the screening baskets 3, 4 in cooperation with an end flange 13 of the reinforcing device 2 in the form of a support sleeve, the cover part 8, the base part 6 and the variable-diameter intermediate ring 10 are centrally positioned, clamped and fixed.

In the screening device according to the invention, when the axial clamping force is applied with the clamping screws 12, the two screening baskets 3, 4 are effectively centered one after the other, with these two screening baskets 3, 4 at the same time being firmly clamped in cooperation with the variable-diameter intermediate ring 5 against each other and against the interior wall of the reinforcing device 2.

Figure 5B:
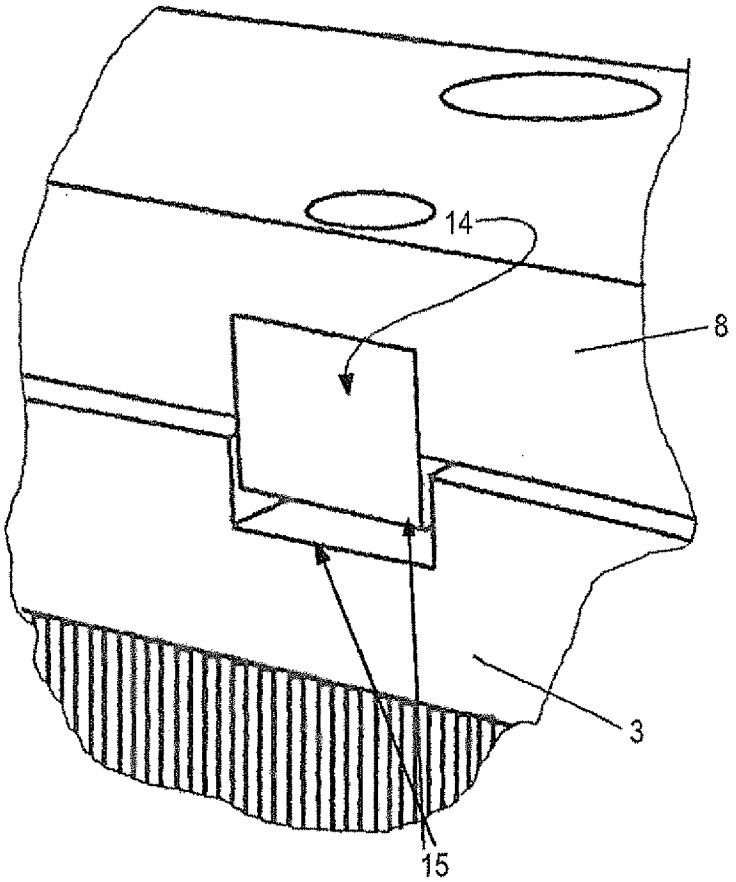
FIGS. 5*a* and 5*b* a sectional view and a schematic perspective detailed view showing a rotation lock in the upper region of the screening device.
Figure 5A:
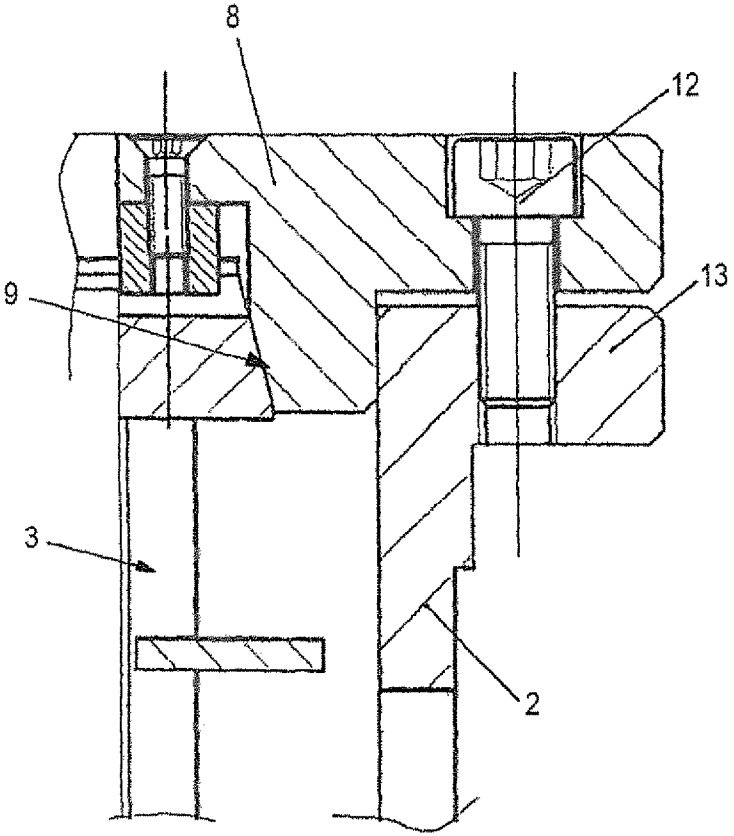

FIGS. 5*a* and 5*b* illustrate an optional for rotation lock 14, which is in the illustrated example designed as a pin and groove arrangement 15. This rotation lock 14 prevents a relative rotation between the cover part 8 and the second screening basket 3.

Figure 6B:
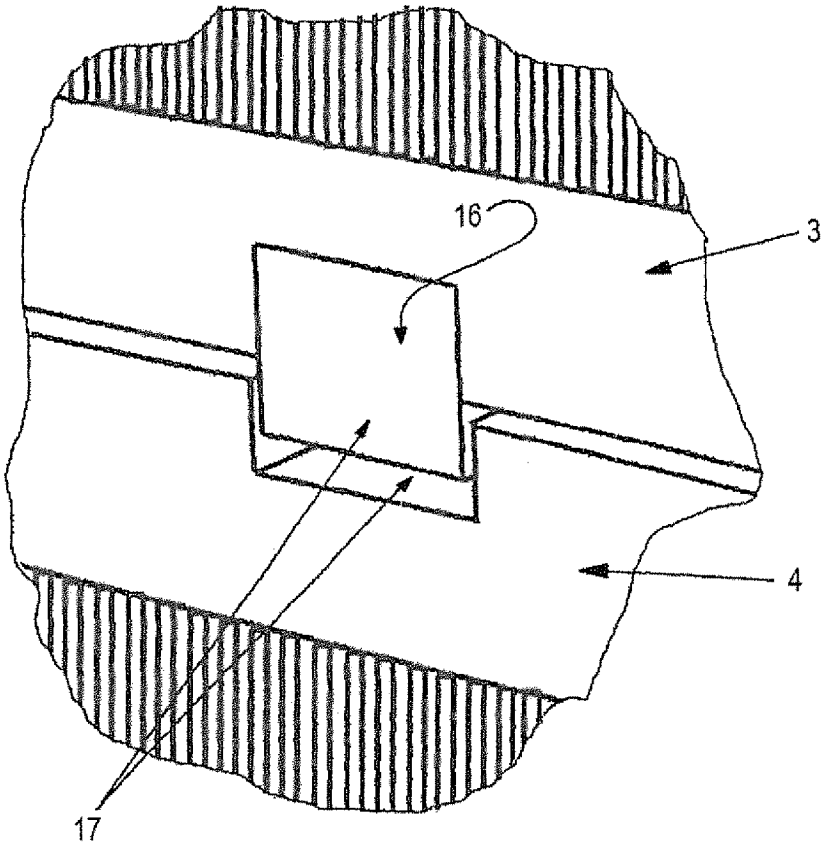
FIGS. 6*a* and 6*b* a schematic sectional view and cut-away perspective detailed view showing a rotation lock in the intermediate region of an intermediate ring.
Figure 6A:
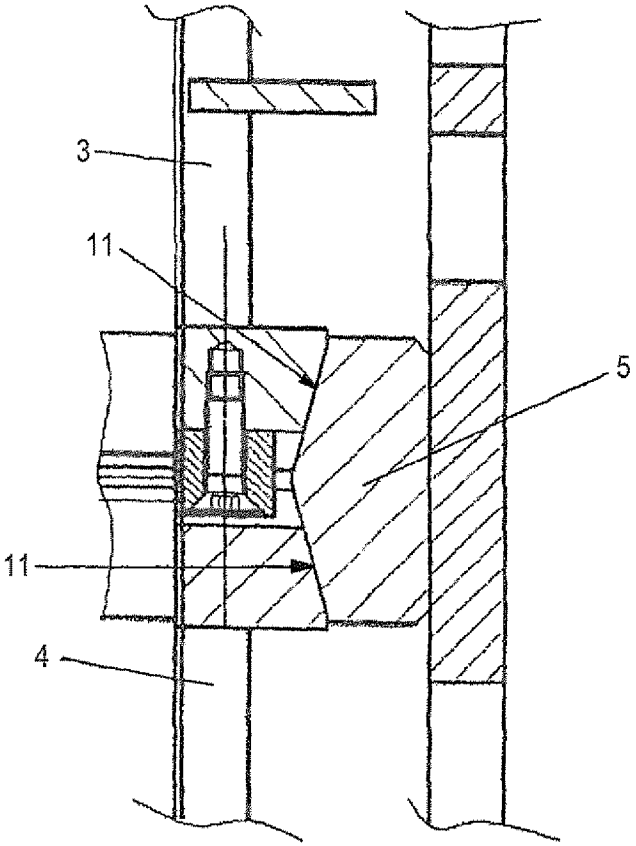

FIGS. 6*a* and 6*b* show a rotation lock 16 which is also preferably designed in the form of a pin and groove arrangement 17 that is effective between the two axially abutting ends of the two screening baskets 3, 4, and effectively prevents a rotation of the screening baskets 3, 4 relative to each other.

Figure 7B:
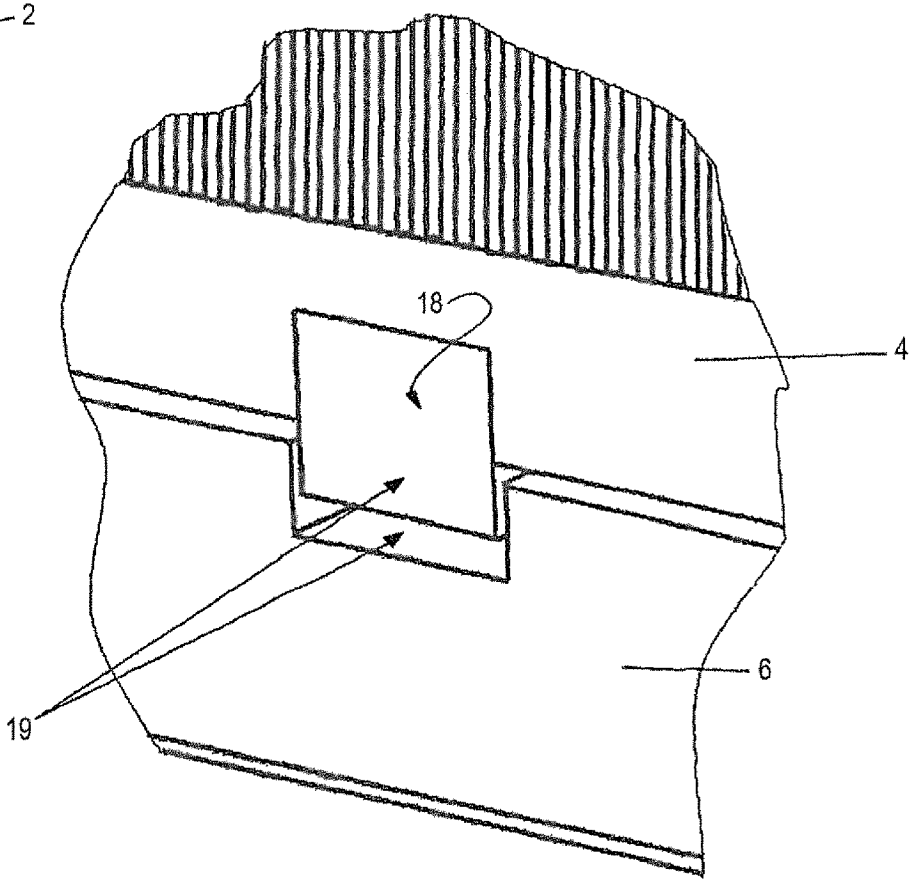
FIGS. 7*a* and 7*b* a schematic sectional view and a perspective view illustrating a rotation lock at the bottom region of the screening device according to the invention.
Figure 7A:
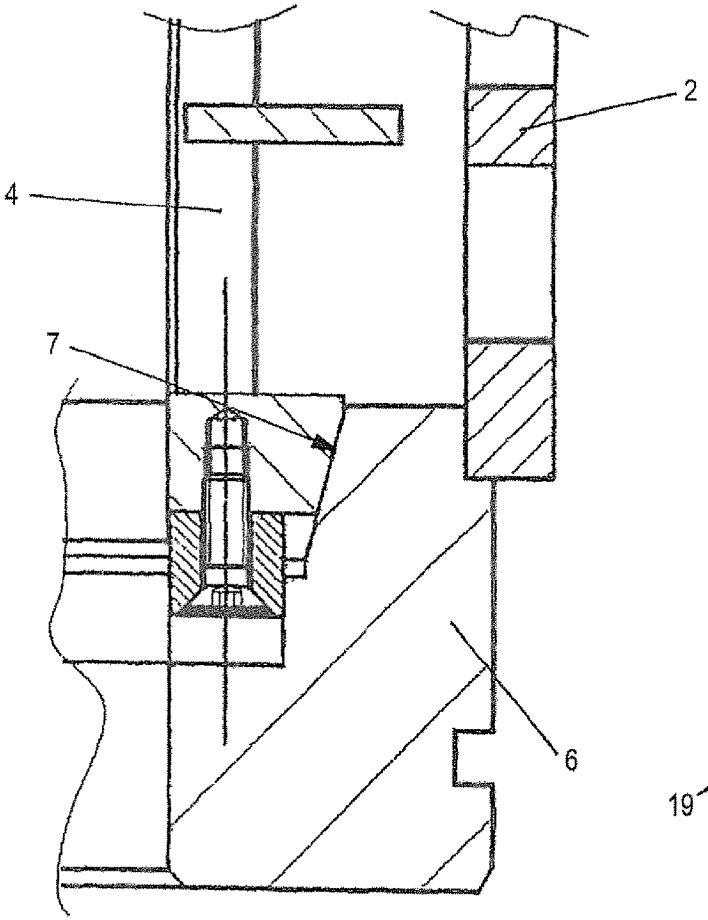

FIGS. 7*a* and 7*b* illustrate a rotation lock 18 optionally provided at the bottom, which is preferably also designed as a pin and groove arrangement 19 and effectively prevents a relative rotation between the first screening basket 4 and the bottom part 6.

Figure 8B:
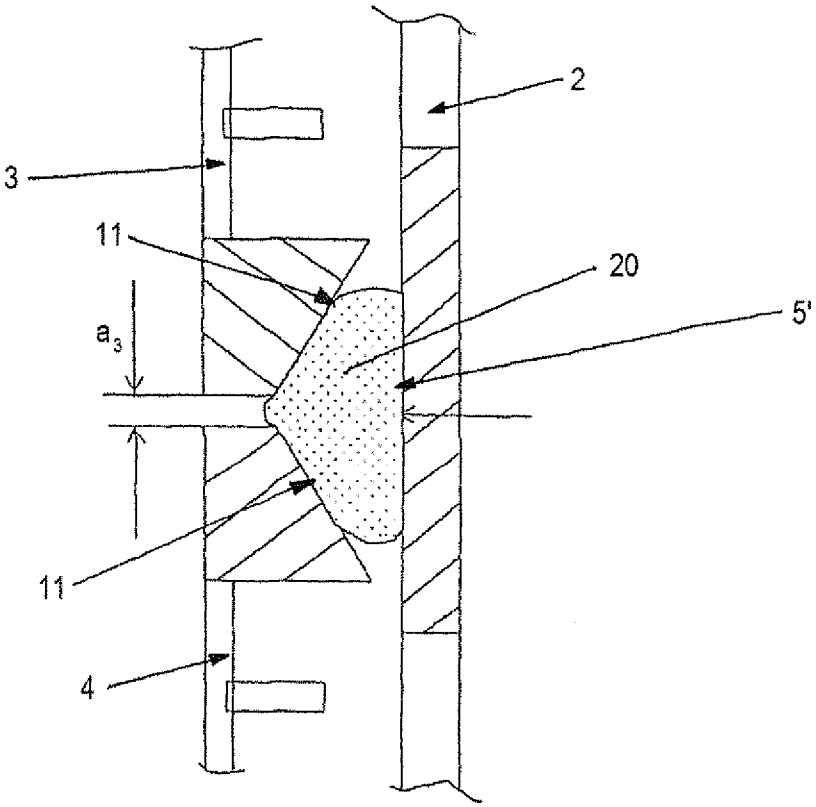
FIGS. 8*a* and 8*b* schematic views illustrating an alternative embodiment of a variable-diameter intermediate ring.
Figure 8A:
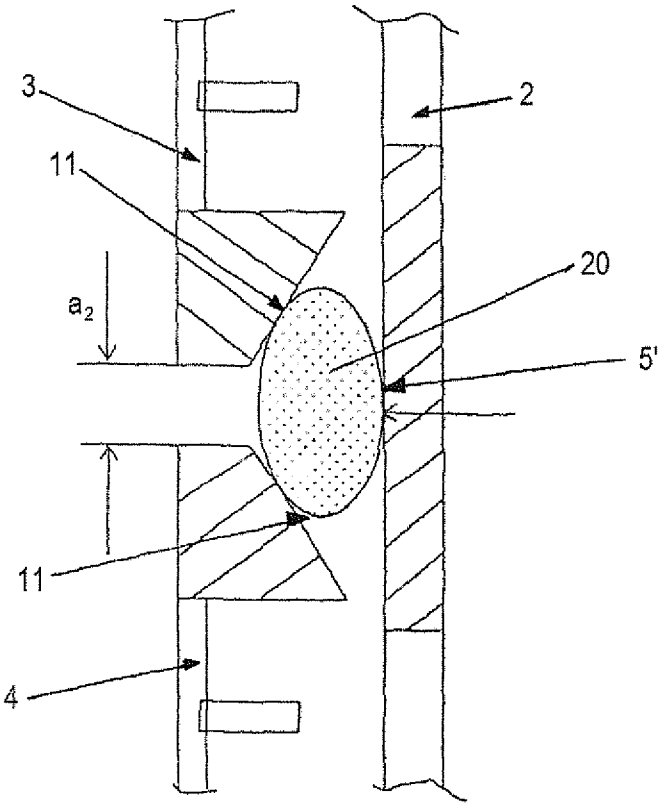

FIGS. 8*a* and 8*b* lastly illustrate an alternative embodiment of a variable-diameter intermediate ring 5, which is designed as an elastomer ring 20. The elastomer ring 20 has an uninterrupted or continuous configuration and is deformed and pressed, starting from the loosely mounted state according to FIG. 8*a*, under the action of the applied axial clamping force according to FIG. 8*b*, so that even in the state shown in FIG. 8*b* there is no gap between the interior wall of the reinforcing device 2 and the corresponding axial ends or the end flanges of the two screening baskets 3, 4.

What is claimed is:

1. A screening device for fibrous suspensions in the paper industry, comprising:

at least two separate, substantially cylindrical screening baskets arranged sequentially in an axial direction, each screening basket forming a screening surface, a reinforcing device constructed as a support sleeve and having an end flange at one axial end, with the reinforcing device surrounding the screening basket with a radial spacing therebetween, a variable-diameter intermediate ring interposed between the at least two screening baskets, a cover part and a bottom part, wherein the at least two screening baskets in cooperation with the end flange of the reinforcing device, the cover part, the bottom part and the intermediate ring are centrically placed, clamped and fixed inside the reinforcing device.

2. The screening device of claim 1, wherein the variable-diameter intermediate ring is split.

3. The screening device, of claim 1, wherein the variable-diameter intermediate ring is slotted.

4. The screening device of claim 1, wherein the variable-diameter intermediate ring is formed by an elastomer ring.

5. The screening device of claim 1, wherein the cover part and the bottom part in cooperation with ends of the at least two screening baskets form in each case a rotation-locked unit.

6. The screening device of claim 5, wherein the rotation-locked unit is constructed as a pin and groove arrangement.

7. The screening device of claim 1, wherein the intermediate ring and ends of the at least two screening baskets form a rotation-locked unit.

8. The screening device of claim 6, wherein the rotation-locked unit is constructed as a pin and groove arrangement.

9. The screening device of claim 1, wherein the cover part, the bottom part and the intermediate ring form a non-positive connection with the at least two screening baskets by way of a spline connection.

10. The screening device of claim 9, wherein the spline connection is formed as a conical seat connection.

11. The screening device of claim 1, wherein the screening device is assembled by arranging in the reinforcing device a first of the at least two screening baskets which rests on the bottom part, by placing the variable-diameter intermediate ring on an upper axial end of the first screening basket, by placing a second of the at least two screening baskets on the variable-diameter intermediate ring, and by placing the cover part on an upper axial end of the second screening basket, wherein when an axial clamping force is applied to the assembled screening device, the intermediate ring is spread open in a circumferential direction and bears gap-free against the axial ends of the at least two screening baskets in the radial direction.

12. The screening device of claim 1, wherein the at least two screening baskets have different characteristics selected from slot width, slot shape, partitions, profile depth, profile size and profile slope.

* * * * *